United States Patent [19]

Monahan

[11] Patent Number: 4,995,134

[45] Date of Patent: Feb. 26, 1991

[54] MOP CONNECTOR

[76] Inventor: Patrick H. Monahan, 239 S. Pine St., Arcola, Ill. 61910

[21] Appl. No.: 374,242

[22] Filed: Jun. 30, 1989

Related U.S. Application Data

[63] Continuation of Ser. No. 95,323, Sep. 10, 1987, abandoned.

[30] Foreign Application Priority Data

Aug. 31, 1988 [NZ] New Zealand ..... 225998
Sep. 6, 1988 [AU] Australia ..... 21887/88

[51] Int. Cl.[5] ..... A47L 13/258

[52] U.S. Cl. ..... 15/151; 15/105; 15/147 R; 15/229.1

[58] Field of Search ..... 15/147 R, 105, 111, 15/229.1, 229.2, 229.6, 236 R, 151, 152, 171, 173; 403/345, 375

[56] References Cited

U.S. PATENT DOCUMENTS

| | | | |
|---|---|---|---|
| 3,328,822 | 7/1967 | Sellesi | 15/151 |
| 3,447,183 | 6/1969 | McClung | 15/151 |
| 3,457,581 | 9/1969 | Oas | 15/147 R |
| 3,947,913 | 4/1976 | Nelson | 15/111 |
| 3,996,638 | 12/1976 | Scarola | 15/151 |
| 4,524,479 | 6/1985 | Wright | 15/229.2 X |
| 4,553,282 | 11/1985 | Batchelor | 15/229.2 X |

FOREIGN PATENT DOCUMENTS

| | | | |
|---|---|---|---|
| 1083761 | 8/1919 | Canada | 15/147 R |

*Primary Examiner*—Edward L. Roberts
*Attorney, Agent, or Firm*—Jerome P. Bloom

[57] ABSTRACT

Invention embodiments comprise two separate and distinct parts, a mop support device and a cap embodying a tubular portion defining a through passage which is tapped intermediate its ends, to enable a secure balanced connection thereof to a mop handle. In the embodiment illustrated the mop support device is comprised of a narrow elongated plate-like saddle portion one face of which mounts a plurality of parallel, relatively spaced, perpendicularly projected pins and coupling elements which project therefrom in generally the same direction as the pins. Projected portions of said coupling elements interrelate with complementary engaging elements disposed within and forming part of the cap. The mop support device is easily applied to and through a mop to establish its saddle portion and pins in underlying engaged relation to a distinct portion of the applied mop which is set within the limits of its projected coupling elements. Upon coupling the mop support device to the cap, the portion of the mop supported thereby and engaged by its pins is clamped to longitudinally spaced lower edges of plate-like ribs formed within said cap. Said pins and said plate-like ribs are so positioned and interrelated as to firmly engage the portion of the mop therebetween in a relatively offset relation, by virtue of which the mop is securely but releasably anchored to its connector in a positively balanced condition which lends optimal ease and efficiency in use thereof.

14 Claims, 1 Drawing Sheet

MOP CONNECTOR

This is a continuation of presently copending application Ser. No. 07/095,323 filed Sept. 10, 1987, now abandoned.

BACKGROUND OF THE INVENTION

This invention relates to a new and improved mop connector device which, as compared to prior art devices intended for use for the same purpose, is inexpensive and easy to fabricate, more efficient and satisfactory in use, adaptable to a variety of applications, unlikely to malfunction and affords ease in its maintenance, all of which contributes to inobvious ancillary environmental benefits.

Embodiments of the invention are distinguished by features the use of which eliminates problems frequently experienced in use of prior art devices having similar application, such problems including, by way of example and not by way of limitation, (a) inadvertent release and/or malfunction of those portions of a mop connector which are normally intended to secure a mop thereto; (b) difficulties in readily removing therefrom an applied handle and/or maintaining a proper connection as between such handle and the mop connector to which it applies; (c) a construction of a mop connector which is such as to provide poor balance in its connection to a handle and resulting undue stress in manipulating and applying the interconnected mop to its intended use.

Preferred embodiments of the invention provide a mop connector featuring two distinct and separate parts which are simply constructed to positively engage and secure therebetween a limited portion of a mop in a manner to establish it as an extension thereof which is essentially integrated therewith and has a firmly balanced relation thereto but is nevertheless capable of being disconnected therefrom with great ease, at frequent intervals, as and when desired for purpose of its cleansing and storage or further application by a reassembly thereof in the manner originally provided.

It is noted for purposes of comparison that the state of the prior art appears to be best represented by the following U.S. Pat. Nos.:

| | |
|---|---|
| 1,027,209 | 3,827,099 |
| 2,310,372 | 4,097,952 |
| 3,593,359 | 4,144,224 |
| 3,748,682 | 4,553,282 |

The references which have been cited in the aforesaid application for U.S. Letters Patent Ser. No. 07/095,323 filed Sept. 10, 1987 consist of the following:

| | | |
|---|---|---|
| McClung | 3,447,184 | 6/1969 |
| Wright | 4,524,479 | 6/1985 |
| Auwarter | 3,187,363 | 6/1965 |
| Sellesi | 3,328,822 | 7/1967 |
| Scarola | 3,996,638 | 12/1976 |
| Batchelor | 4,553,282 | 11/1985 |
| Haydu | 2,533,799 | 12/1950 |

SUMMARY OF THE INVENTION

Preferred embodiments of the present invention provide a mop connector featuring an assembly of two separate and distinct parts, a cap structure and a mop support device which are adapted to be securely coupled and to fix therebetween a portion of a mop so applied to said support device that the remainder of the mop projects therefrom and forms a direct extension thereof and of the assembly of which it forms a part. The cap structure per se embodies means which enables a balanced connection thereof to a mop handle. The mop support device is distinguished by a saddle portion and adapted to be applied within the cap, at least in part. Said saddle portion provides means for engaging a portion of a mop and includes a plurality of spaced, relatively projected, coupling devices which interrelate with complementary coupling devices provided within the interior of the body of the cap structure to not only produce a firm but releasable connection between said parts but a construction and arrangement of said assembly which precludes inadvertent or accidental disconnection of said parts.

In most preferred embodiments means which contribute to the achievement of a balanced connection of said assembly to a mop handle is provided by a sleeve interconnected with and projected, at least in part, from said cap structure, the inner wall surface of which sleeve is tapped intermediate its ends to provide for a long bearing secured and balanced interconnection of a mop handle therewith.

A most preferred embodiment of a mop connector per the present invention likewise comprises a mop support device and an interconnecting cap structure. In this instance the mop support device is formed to include a narrow, relatively rigid, plate-like, relatively elongated, generally rectangular saddle portion connected to and projected from one face of which are a plurality of relatively rigid pins which are relatively spaced and generally perpendicular thereto and have the projected extremities thereof conically pointed for the engagement thereof in and to an overlying portion of the mop which it supports. Further connected with and upstanding from each of the respective ends of such saddle portion is a support or suspension strap. The projected extremity of each of these straps is shaped for a secure but releasable interconnection thereof with one of a plurality of complementary coupling devices connected with and disposed within the interior of said cap structure to establish the mop support device and the mop supported thereby in a firmly secured balanced relation to said cap structure.

A further particularly preferred embodiment of the invention also comprises two separate and distinct parts, namely a mop support device and a cap. In this embodiment the cap has an integrally connected tubular portion defining a through passage which is tapped intermediate its ends, to enable a secure balanced connection thereof to a mop handle. The mop support device is comprised of a narrow elongated saddle portion one face of which mounts a plurality of parallel, relatively spaced, perpendicularly projected pin-like elements and at the periphery thereof coupling elements which project therefrom in generally the same direction as said pins. Projected portions of said coupling elements interrelate with complementary engaging elements disposed within the interior of the body of said cap. The mop support device so provided is easily applied to and through a mop to establish its saddle portion and pin-like elements in underlying engaged relation to a distinct portion thereof which is set within the limits of its projected coupling elements. Upon coupling the mop support device to the cap, the portion of the mop supported thereby and engaged by its pins is clamped to longitudinally spaced lower edges of plate-like ribs formed within said cap. Said pins and said plate-like ribs are so positioned and interrelated as to firmly engage the portion of the mop therebetween in a relatively offset relation, by virtue of which the applied mop is releasably anchored to its connector and positively balanced to lend optimal ease and efficiency in the use thereof.

According to the present invention any embodiment thereof may be most advantageously enhanced by the connection to its saddle portion, in underlying relation thereto, of means which are so formed as to faciltitate in use thereof the dislodgement from a surface of such dirt or soil as may be caked thereon or otherwise adhered and difficult to remove by an ordinary mopping procedure.

As previously stated, in a broad context preferred embodiments of the invention provide a mop connector featuring two distinct and separate parts which are simply constructed to positively engage and secure therebetween a limited portion of a mop in a manner to establish it as an extension thereof which is essentially integrated therewith and has a firmly balanced relation thereto but is nevertheless capable of being disconnected therefrom with great ease, at frequent intervals, as and when desired for purpose of its cleansing and storage or further application by a reassembly thereof in the manner originally provided.

Common to all embodiments of the invention is a simplicity of its construction, an ease and economy of its manufacture, a facility to expedite a quick and trouble free assembly and disassembly of its parts and a quick and secure attachment of a mop thereto or release of the mop therefrom as and when needs require without perceptible or material damage to its parts or the mop per se. The latter not only facilitates and encourages frequent cleaning of the attached mop but also, as a result thereof, enables such a mop (excluding paper mops) to maintain a high level absorption and cleansing capability, derivatively enables a reduction of the time and energy entailed in each and every mopping operation to which it is applied and in fact extends its useful operative life. Contributing to the latter is the balanced and secure mount of a mop provided by embodiments of the invention. At the same time the frequent cleaning of the attached mop induced by the improved construction of the invention embodiments eliminates the high level of bacteria which normally attaches to this type of tool. This materially benefits both the user and the environment in which the mop is stored and used. All the foregoing benefits implicitly derive, directly and indirectly, from the subject invention.

An added feature of the mop connector of the present invention is that once a mop and a mop handle are releasably attached thereto and the mop assembly so provided placed in use, upon a requirement for or a desire to cleanse the mop all one has to do is to quickly disengage the handle whereupon the assembly of the mop connector and the attached mop may then be washed in a washing machine as a unit. In this respect it has been unexpectedly found in tests that under such circumstances the mop material per se, by virtue of its firmly secured relation to its connector may better survive this thorough washing procedure. This feature not only contributes to the achievement of a cleaner and most effective mop device which can be made relatively germ free and more readily dried for storage purposes but it also enables a mop which is better, longer lasting and more attractive.

Certain highly advantageous embodiments of the present invention may be described as (a) Apparatus for connecting a mop to a handle comprising a mop support and a cap which are separate and distinct elements, said mop support comprising a narrow elongated saddle portion having at each end of one surface thereof means defining a relatively projected, self stablized support strap, said support straps having a limited degree of flexibility and being laterally aligned and normally conditioned to position in a relatively outwardly biased divergent relation, said saddle portion of said mop support being adapted to mount a mop over, in draped relation thereto and intermediate the limits thereof defined by said support straps, said support straps each having coupling means in connection therewith, said cap being an integral shell-like structure having a top and a peripherally dependent wall structure and including means for the interconnection thereto of a mop handle, each of opposite portions of the inner surface of said wall structure having strap retention means in connection therewith, said retention means being cup shaped at least in part, disposed within the interior of said cap and, in the assembled relation of said mop support and said cap, respectively nesting coupling means of one of said support straps, within the cup thereof in the interior of said cap, in a laterally contained biased relation thereto precluding inadvertent or accidental displacement of said mop support from said cap, said strap retention means each comprising two strap-like portions which are in a side by side spaced parallel relation, connected at one end to one of said opposite portions of said inner surface of said wall structure and projected therefrom in the direction of the other of said opposite portions of said inner surface of said wall structure and the strap-like portions of the retention means which project therefrom.

(b) Mopping apparatus comprising a mop support and a cap which are separate and distinct elements, said mop support comprising a narrow elongated saddle portion having at each end of one surface thereof means defining a relatively projected, upstanding self stablized suspension strap, said suspension straps having a limited, outwardly biased divergent relation, said saddle portion of said mop support mounting over said one surface thereof, between said suspension straps, an intermediate portion of the length of a layered structure defining a mop which is applied in a draped relation thereto, at least said intermediate portion of the length of such applied mop being compressible in response to applied pressure and self expanding on release of applied pressure, said one surface of said saddle portion having means in connection therewith engaging said intermediate portion of the length of such applied mop to set the position thereof on said saddle portion between said suspension straps, said suspension straps each having coupling means in connection therewith, said mop support and said applied mop being a distinct separate sub-assembly of said apparatus, said cap being an integral shell-like structure having a top and a peripherally dependent wall structure having in connection therewith, within the interior thereof, means to receive and retain said coupling means of said suspension straps to and within the interior of said cap, in coupled relation thereto.

(c) Apparatus for connecting a mop to a handle comprising a mop support and a cap which are separate and distinct elements, said mop support comprising a saddle portion having at each end of one surface portion thereof means defining an upstanding relatively projected, self stabilized support strap, said support straps having a limited degree of flexibility and being normally positioned in a limited outwardly biased divergent relation, said saddle portion being arranged to mount over said one surface thereof, between said support straps, an intermediate portion of the length of a layered structure defining a mop which is in a draped relation thereto and formed of material that is compressible in response to applied pressure and self expanding on release of applied pressure, said support straps each having coupling means in connection therewith, said cap being an shell-like structure having a top and a dependent wall structure having in connection therewith, within the interior thereof, means to receive and nest said coupling means of said support straps to and within the interior of said cap and in a coupled relation thereto precluding inadvertent or accidental displacement of said mop support from said cap.

It is accordingly a primary object of the invention to provide a new and improved mop connector which, as compared to prior art devices intended for use for the same purpose, is inexpensive and easy to fabricate and assemble, more efficient and satisfactory in use, adaptable to a variety of applications, unlikely to malfunction, affords ease in its maintenance, and derivatively contributes important ancillary environmental benefits to users.

A further object is to provide a mop connector device the improvements in which facilitate a firmly balanced and secure connection of a mop and/or its handle thereto yet by virtue of its composition enables frequent disassembly and reassembly thereof without loss of the integrity of the original assembly.

Another object is to provide a mop connector which enables the production of a mop assembly having a high efficiency quotient in its cleansing operations.

An additional object to provide a mop connector which incorporates means which enhances the mop assembly of which it forms a part with special attributes which enable its effective and satisfactory use in cleaning surface areas which are normally difficult to clean.

A further object of the invention is to provide a mop connector with means inherently providing a firm and secure releasable attachment of a mop of reasonably durable material thereto the nature of which enhances the ability of the assembly provided thereby to be cleansed as a unit in a washing machine without adversely affecting such assembly or its parts.

Another object is to provide mop connectors and assemblies thereof possessing the advantageous structural features, the inherent meritorious characteristics and the means and mode of use and application herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents. Referring to the drawings wherein are shown some but not the only forms of embodiment of the present invention, FIG. 1 is an exploded perspective view, taken in vertical elevation, of a mop assembly utilizing a preferred embodiment of a mop connector per the present invention;

Figures 1, 2, 3, 4, 5, 6, 7, 8:
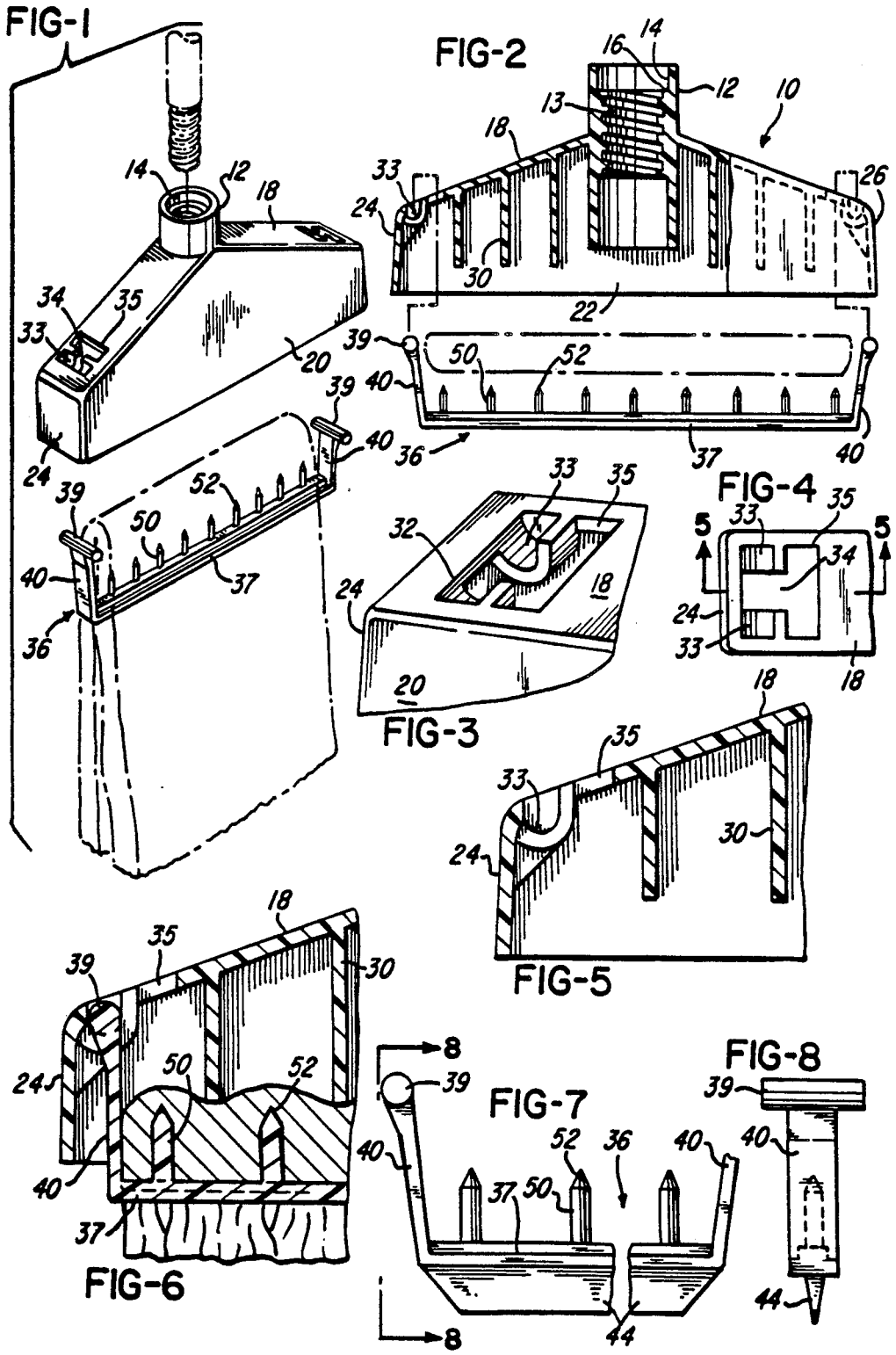
FIG. 2 is an exploded view of the mop connector per se, taken in vertical elevation and partly in section.
FIG. 3 is a relatively enlarged fragmentary perspective view looking inwardly of the top of the cap portion of the illustrated mop connector.
FIG. 4 is a plan view of the top of the fragment of the mop connector of FIGS. 1 and 2 which is shown in FIG. 3.
FIG. 5 is an enlarged sectional view taken on line 5—5 of FIG. 4.
FIG. 6 is a fragmentary cross sectional view of the mop connector of FIGS. 1–5 exhibiting details of the interrelation of its parts when serving their intended function.
FIG. 7 is a view, in front elevation, of a modification of the mop support device forming part of the mop connector illustrated in FIGS. 1, 2 and 6 which is relatively enlarged to exhibit further the details of its composition.
FIG. 8 is a view taken on line 8—8 of FIG. 7. Like parts are designated by similar characters of reference throughout the several views.

Referring to the drawings, a preferred embodiment of the present invention is comprised of an assembly of two separate and distinct parts, a cap structure 10 and a mop support device 36. These parts are shown in vertical elevation and therefore described in this frame of reference.

The mop support device 36 comprises a narrow, relatively rigid, plate-like, relatively elongated, generally rectangular saddle portion 37 spaced longitudinal of the upper surface of which is a line of integrally connected, perpendicularly related, relatively rigid anchor pins 50 the projected extremities 52 of which are conically pointed. Connected with and upstanding from each of the respective ends of the saddle portion 37 is a strap 40 the width of which, as seen in a front elevation view thereof (FIGS. 2 and 7), is relatively thin and as seen in a side elevation view thereof (FIG. 8) has a dimension equal to that of the front to rear width of the saddle portion. The projected end portion of each of the straps 40 is thickened as seen in front elevation (FIGS. 2 and 8) and its extremity is defined by a cylindrically shaped head 39 the longitudinal extent of which as seen in a side view of the device 36 provides the strap with a "T" shape, the respective end portions of the head being equally projected beyond the front and rear edges of the generally vertically oriented length of the strap. As seen in FIGS. 2 and 7, the straps 40 are formed to slightly diverge as they extend upwardly from the respective ends of the saddle portion 37.

The device 36 is preferably molded of a strong plastic material and while the saddle portions 37,50 are relatively rigid the straps 40 are thinned, as seen in the drawings, to lend them a degree of flexibility.

As illustrated, the cap 10 is an integral shell-like structure, preferably molded of a relatively rigid plastic and so configured as to be generally rectangular in horizontal section, relatively narrow from front to rear, laterally extended and comprised of a top wall 18, a front wall 20, a rear wall 22 and side walls 24 and 26. It is distinguished by a vertically oriented sleeve 12 approximately one third of the length of which projects through, upwardly from and in a laterally centered relation to the top wall 18. The dimension of the outer diameter of the sleeve 12 is such that it bridges and merges with the laterally centered portions of the uppermost limits of the front wall 20 and rear wall 22, which are formed integral with, complimentary to and are otherwise bridged by the top wall 18, from which they depend in a relatively closely spaced, parallel, relatively aligned relation (FIGS. 1 and 4).

The sleeve 12 divides the top wall 18 into sections of equal length the adjacent uppermost ends of which are respectively merged with and connected to respectively diametrically opposite approximately 180 degree outer surface portions of the sleeve 12, from which they slope downwardly and symmetrically extend to respectively merge at their lowermost ends with the upper end of that one of the laterally aligned and substantially spaced side wall portions 24, 26 of the cap 10 which is most adjacent thereto. As will be self evident, the upper limits of the front and back walls 20 and 22 are necessarily provided with a shape complementary to that of the profile of the top wall 18 and define therewith an upper portion of the cap 10 which gives it a peaked configuration, projected through and upwardly of the peak of which is the aforementioned approximately one third of the length of the sleeve 12.

In the embodiment illustrated the vertical extent of the opposite side wall portions 24 and 26, which slightly diverge from their upper to their lower limits, is approximately one half that of the body of the cap per se, exclusive of the projected portion of the sleeve 12. The lower portion of the sleeve 12 depends between, is parallel to and equidistant from upper portions of the side walls 24 and 26.

Within the shell of the cap 10 so defined, the front and back walls 20 and 22 are bridged by integrally connected, laterally spaced, vertically oriented plate-like ribs 30 which are perpendicular thereto and have their upper edges merged with and coextensively connected to the top wall 18. The lower edges of the ribs 30 are laterally aligned and in a plane which is just below the lowermost end of sleeve 12 and in an adjacent, spaced, parallel relation to the plane commonly occupied by the lower edges of the walls 20, 22, 24 and 26. In the example illustrated three of these ribs 30 are located between one side of sleeve 12 and side wall 24, in a parallel equidistantly spaced relation to each other and to have the rib most adjacent the sleeve in a similarly spaced, parallel relation thereto. A greater spacing is provided between the side wall 24 and the rib 30 most adjacent thereto. Three additional ribs 30 are installed and identically arranged within the cap 10 between the opposite side portion of the sleeve 12 and the side wall 26.

That portion of the interior of the cap 10 below the plane of the lower extremities of the ribs 30 and bounded by the further dependent portions of its walls 20, 22, 24 and 26 defines therein a cavity which opens from its bottom. As will be further described, in the coupling thereof to the cap 10 at least a portion of the device 36 and at least part of the depth of that portion of the mop which is supported on and engaged by the saddle portion of the device 36 will nest within said cavity.

The top wall 18 of the cap 10 has therein a small rectangular opening 32 which is immediately adjacent the upper limit of the end wall 24, which opening is followed, in immediate succession, in the direction of end wall 26, by a short intersecting slot 34 and a second rectangular opening 35. Opening 35, which is likewise intersected by slot 34, is located short of and in spaced relation to the centrally located sleeve 12.

Formed within the interior of the shell-like body defining the cap 10, immediately under the opening 32, are two strap-like elements 33. As seen in FIGS. 2, 3, 5 and 6, each of the strap elements 33 has one end thereof integrally interconnected with a portion of the inner surface of the side wall 24 adjacent its upper extremity and the length thereof projected in the direction of end wall 26. the length of each of the identically formed strap-like elements 33 is provided with an arcuately configured profile presenting a cup or modified hook shaped configuration resembling that of a "J", the cup portion of which is immediately adjacent end wall 24 and at the end thereof remote from the wall 24 the cup is vertically extended to have its projected extremity merge with a portion of the top wall 18 of cap 10 to one side of slot 34.

As shown in the drawings, the projected extremities of the parallel, laterally spaced strap-like elements 33 respectively and immediately bound slot 34 and the space between the strap elements effectively defines a slot in the strap retention means which is a continuation of slot 34. As will be seen, the adjacent side surfaces of strap-like elements 33 are in an aligned closely spaced parallel relation and have a distance therebetween the dimension of which corresponds to the width of slot 34, which is slightly greater than that of the front to rear width of the support straps 40 of the mop support device 36. The remote side surfaces of strap-like elements 33 are respectively connected to the front and back walls of cap 10. The end portion of the half section of top wall 18 most remote from the side wall 24 is provided with a series of like openings 32, 35 and 34 similarly positioned immediately of and similarly related to the side wall 26 to afford a view of and access to a pair of identically formed, reversely directed, similarly installed straps 33. Since the precise details of this structure are above set forth and clear from the accompanying drawings, a repetitious discussion thereof appears unnecessary.

The sleeve 12 functions as an adapter by means of which the cap structure 10 can be easily and firmly applied to the lower end of a pole-like mop handle to form an extension thereof which is completely balanced. To this end a section 13 of the inner surface of sleeve 12, which extends preferably about one half the length thereof and is located intermediately of and spaced from its respective counterbored ends, is tapped and provided with a thread which will be complementary to a mating thread on the end of the mop handle to be applied thereto. Note should be taken of the fact that the axial length of the counterbore 14 which is at the upper end of the sleeve 12, as seen in the drawings, is relatively short. Note also that the uppermost ends of the respective sections of the top wall 18 are joined and merged with the sleeve at a level thereof which is approximately centered with reference to the axial length of the tapped portion 13 of the inner surface of the sleeve. The construction and arrangement of sleeve 12 and its relation to the remainder of the cap 10 as above described contributes not only to durability of a mop assembly enabled by the invention but a significant efficiency and ease of its manipulation and use.

As may be seen from FIGS. 1, 2 and 6 of the drawings, the device 36 may be readily applied to and through a mop to establish its saddle portion 37 and perpendicularly projecting pins 50 in underlying relation to a distinct integral portion of the mop which is centered between the straps 40. Take particular note of the fact that in the illustrative embodiment and application of the present invention shown in the drawings the mop material per se is a layered sheet-like structure which is compressible and consequently self-expanding upon release of any pressure which effects its compression. Furthermore, on the mount of this mop material to the device 36 that portion thereof which overlies the saddle 37 and the laterally spaced pins 50 which project upwardly therefrom is inherently engaged by the conical extremities of the pins, which effectively set this engaged portion of the mop within the longitudinal extent of the saddle 37 and between inner end portions of its integrally connected, outwardly projected, relatively divergent, laterally bounding straps 40.

The sub-assembly so provided may be easily moved into the cap 10, by way of the opening at its bottom with the heads 39 of straps 40 in leading relation thereto. In the course thereof straps 40 are flexed, against the inherent bias thereof, to move their heads 39 towards each other sufficiently to align them with the apertures 35 in the top wall 18. Holding the saddle portion 37 at its bottom and straps 40 in this flexed condition, the saddle and the portion of the mop thereon are then moved in a direction inwardly of the cap 10. As this sub-assembly is so moved to advance the heads 39 of the straps 40 to and through the apertures 35, pressure is applied through the saddle 36 as the upper or outermost surface of that transverse portion of the mop material which is mounted by the saddle comes into engagement with the facing extremities of the ribs 30 within cap 10 to effect a compression of this mop material in the area of the ribs and thereby permit the advancement of the sub-assembly sufficiently within the cap to effect a projection of the heads 39 through, slightly outward of and beyond the apertures 35 in its top wall 18. This results in an alignment of the respective portions of the straps 39 immediately below their heads with the spaces between the respective pairs of straps 33 and the respective slots 34 in the top wall 18. The flexing pressure on the straps 40 is then removed, as a result of which the straps inherently self bias into and through the respectively adjacent slots 34, into the apertures 32 which communicate therewith. In the process thereof portions of the straps 40 immediately of their heads 39 move in each case between a pair of the straps 33, at which point each said head is positioned directly above and outwardly of the top wall 18 of cap 10 to dispose its laterally projected end portions respectively over and outwardly of the cup shaped straps 33 thereunder.

Note must be taken of the following facts. First the cup-shaped straps 33 are disposed fully within and in recessed relation to the body of cap 10. Secondly, pins 50 as mounted to the saddle base 37 are so spaced as to be positioned in uniformly offset relation to the ribs 30 as the mop support device is assembled to the cap 10. Thirdly, the portion of the mop material held by and within the limits of the device 36 is compressible and significantly compressed between the pins 50 and offset ribs 30 in achieving the positioning of the strap heads 39 immediately over and in line with the openings to the recessed pockets defined by the cup-shaped straps 33. Given the foregoing plus the fact that the positioning of the strap heads 39 outwardly of cap 10 is effected and maintained by an application of pressure to the saddle forming the base of the sub-assembly which has been moved inwardly of the cap, all one needs to do to cause the heads 39 to retract into these pockets and be seated within and in recessed relation to the body of the cap 10 is to release the pressure applied to the sub-assembly. Upon release of this pressure, the material compressed between the saddle portions 37, 50 will naturally expand and in the process thereof inherently induce the seating of the heads of the straps 40 to the base surface portions of the pockets defined by the straps 33. The portion of the mop material supported by the device 30 will then be clearly and firmly engaged by the pointed extremities of pins 50 and held by the offset interrelation thereof with ribs 30. See FIG. 6 in this respect and in respect to the fact the displaced offset relation of the projected limits of ribs 30 and pin portions 32 inherently in the relaxed condition of the portion of the applied mop which positions therebetween is such to provide undulations in the uppermost surface of such material which effectively resist lateral distortion or displacement of the mop from its securely set position.

Further the recessed interconnection of the device 36 to the cap 10 as here provided not only achieves a firm though releasable assembly of these parts but inhibits the occurrence of accidental or inadvertent disengagement thereof, even in the course of a vigorous use of the mop which is supported and held thereby.

FIG. 7 shows a modification of the device 36 which may be highly advantageous for application to such embodiments of the invention as may by intended for use on surfaces plagued with caked deposits of soiling materials which are difficult to remove. In this modification saddle portion 37 is provided with an underlying integrally connected, relatively projected relatively rigid rib 44 which extends longitudinally thereof. As seen in FIG. 8, the rib 44 is laterally centered and has a cross section which is in the shape of a symmetrical triangle the peak of which is outermost and the surface thereof preferably roughened to enable the rib to be applied to remove soil which cannot be removed by conventional mopping devices.

As previously stated, in a broad context preferred embodiments of the invention provide a mop connector featuring two distinct and separate parts which are simply constructed to positively engage and secure therebetween a limited portion of a mop in a manner to establish it as an extension thereof which is essentially integrated therewith and has a firmly balanced relation thereto but is nevertheless capable of being disconnected therefrom with great ease, at frequent intervals, as and when desired for purpose of its cleansing and storage or further application by a reassembly thereof in the manner originally provided. In this latter respect it has been found by test that the mop as assembled to its connector may be introduced to a washing machine and washed therein as a unit and that such a procedure, as contrasted to the washing of the mop as a separate part, provides the mop with a longer and more useful effective life.

It should be readily apparent from the foregoing that the present invention has achieved all the aforementioned objectives and derivatives benefits and that in the use of its simplistic embodiments consumers are provided with most advantageous, significant and beneficial improvements in the art to which the invention relates.

From the above description it will be apparent that there is thus provided a device of the character described possessing the particular features of advantage before enumerated as desirable, which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. Apparatus for connecting a mop to a handle comprising a mop support and a cap which are separate and distinct elements, said mop support comprising a narrow elongated saddle portion having at each end of one surface thereof means defining a relatively projected, self stabilized support strap, said support straps having a limited degree of flexibility and being laterally aligned and normally conditioned to position in a relatively outwardly biased divergent relation, said saddle portion of said mop support being adapted to mount a mop over, in draped relation thereto, and intermediate the limits thereof defined by said support straps, said support straps each having coupling means in connection therewith, said cap being an integral shell-like structure having a top and a peripherally dependent wall structure the dependent limit of which bounds an opening at its bottom and includes means for the interconnection thereto of a mop handle, said peripherally dependent wall structure being rectangular and oblong in horizontal section, the opposite most remote inner side wall surfaces of said dependent wall structure defining the limits of the length thereof, each of said opposite most remote portions of the inner surface of said wall structure having strap retention means in connection therewith, said retention means being cup shaped at least in part, disposed within the interior of said cap and, in the assembled relation of said mop support and said cap, respectively nesting coupling means of one of said support straps, within the cup shaped part thereof in the interior of said cap, in a laterally contained biased relation thereto precluding inadvertent or accidental displacement of said mop support from said cap, said strap retention means each comprising two strap-like portions which are in a side by side spaced parallel relation, connected at one end to one of said remote opposite portions of said inner surface of said wall structure and projected therefrom in the direction of the other of said remote opposite surface portions of said inner surface of said wall structure and the strap-like portions of the retention means which project therefrom.

2. Apparatus as in claim 1 wherein each said strap-like portion of said strap retention means is cup shaped in configuration immediately adjacent that portion of the inner surface of said wall structure from which it projects and the end thereof remote from that inner side surface of the cap from which it projects is extended in the direction of said top of said cap, said strap-like portions of each said strap retention means define therebetween a slot and said slots are shaped to freely pass said coupling means to and from the cup shaped portions of said support straps in the assembly of said mop support to and the disassembly thereof from the cap.

3. Apparatus as in claim 2 wherein said strap-like portions of each said strap retention means which define therebetween a slot have those portions thereof remote from the inner wall surface portion of said dependent wall structure of said cap from which they project merged with portions of the top of said cap which define therebetween a short slot forming an extension of the slot defined between said merged strap-like portions, said short slot defined in the top of said cap is located immediately between and in intersecting relation to two immediately adjacent additional openings in said top, one of which openings is immediately adjacent the one of said remote opposite portions of the inner surface of said wall structure to which the merged strap retention means connects and above the cup shaped portion thereof and the other of which openings forms a relatively short extension of said short slot and an entry by way thereof for a mop support strap to move to, through and from said short slot and between said merged strap-like portins of the adjacent strap retention means to securely seat said coupling means in nested relation to the cup shaped portion of said adjacent strap retention means.

4. Apparatus as in claim 2 characterized in that a surface of said saddle portion of said mop support is formed to include, as part thereof, means capable of removing such deposits of substance from a floor surface which cannot be removed in use of an applied mop per se.

5. Apparatus as in claim 2 wherein the longitudinal extent of said strap-like portions of said strap retention means have a hook shape and present a profile having a substantially J-shaped configuration in vertical elevation and said support straps which project from said saddle portion of said mop support are laterally aligned and each biased to inherently resist its movement or any part thereof in the direction of the strap aligned therewith while accommodating a limited flexing of an outwardly disposed part thereof in the direction of the aligned strap to enable the application of said straps within said cap and the coupling thereof to said strap retention means within the interior of said cap.

6. Mopping apparatus comprising a mop support and a cap which are separate and distinct elements, said mop support comprising a narrow elongated saddle portion having at each end of one surface thereof means defining a relatively projected, upstanding self stablized suspension strap, said suspension straps having a limited, outwardly biased divergent relation, said saddle portion of said mop support mounting over said one surface thereof, between said suspension straps, an intermediate portion of the length of a layered structure defining a mop which is applied in a draped relation thereto, at least said intermediate portion of the length of such applied mop being compressible in response to applied pressure and self expanding on release of applied pressure, said one surface of said saddle portion having means in connection therewith engaging said intermediate portion of the length of such applied mop to set the position thereof on said saddle portion between said suspension straps, said suspension straps each having coupling means in connection therewith, said mop support and said applied mop being a distinct separate sub-assembly of said apparatus, said cap being an integral shell-like structure having a top and a peripherally dependent wall structure having in connection therewith, within the interior thereof, means to receive and retain said coupling means of said suspension straps to and within the interior of said cap, in coupled relation thereto.

7. Apparatus as in claim 6 wherein said means to receive and retain said coupling means of said suspension straps within said cap are connected to opposite portions of the inner surface of said wall structure, are cup-shaped in configuration at least in part, seat said coupling means of said suspension straps within the interior of said cap in a nested relation thereto and preclude inadvertent or accidental displacement of said mop support from said cap in use of said mop.

8. Apparatus as in claim 6 wherein said means in connection with said one surface of said saddle portion of said mop support engaging said intermediate portion of the length of such applied mop to set the position thereof on said saddle portion between said suspension straps comprise a line of perpendicularly related, relatively projected rigid anchor pins.

9. Apparatus as in claim 8 characterized in that said top of said cap has an integrally formed tubular sleeve a limited portion of the length of which projects outwardly of the top of the cap in a relatively centered relation thereto and a major portion of which projects within the interior of said cap, a portion of the length of the inner surface of said sleeve located intermediately of and spaced from the respective ends of said sleeve is tapped and provided with a thread complementary to a mating thread on that mop handle which is to be applied thereto, said top of said cap mounts interiorly thereof a plurality of bridging integrally connected laterally spaced vertically oriented plate-like ribs the lower edges of which are laterally aligned and in the assembled condition of said apparatus respectively positioned in offset relation to said anchor pins to provide a positively distributed application of force to such mop as may be applied between said mop support and said cap which precludes tearing and separation of the material of the mop in the use thereof for its intended purpose.

10. Apparatus as in claim 8 characterized in that the surface of said saddle portion of said mop support opposite said one surface thereof has relatively projected rib means shaped to facilitate removal of substances adhered to a surface to be mopped which cannot be removed by conventional mopping devices.

11. Apparatus as in claim 8 characterized in that said strap retention means are defined by means having a hook shaped configuration.

12. Apparatus for connecting a mop to a handle comprising a mop support and a cap which are separate and distinct elements, said mop support comprising a saddle portion having at each end of one surface portion thereof means defining an upstanding relatively projected, self stabilized support strap, said support straps having a limited degree of flexibility and being normally positioned in a limited outwardly biased divergent relation, said saddle portion being arranged to mount over said one surface thereof, between said support straps, an intermediate portion of the length of a layered structure defining a mop which is in a draped relation thereto and formed of material that is compressible in response to applied pressure and self expanding on release of applied pressure, said support straps each having coupling means in connection therewith, said cap being an shell-like structure having a top and a dependent wall structure having in connection therewith, within the interior thereof, means to receive and nest said coupling means of said support straps to and within the interior of said cap and in a coupled relation thereto precluding inadvertent or accidental displacement of said mop support from said cap.

13. Apparatus as in claim 12 wherein said top of said cap has an opening therein bounded by an integrated tubular structure a minor portion of the length of which is exterior to said cap and a major portion of the length of which projects within the interior of said cap, said tubular structure defining a through passage the bounding wall of which is tapped intermediately of and in a spaced relation to its ends to provide for a secure and balanced bearing connection thereto of a mop handle and the projection of a mop handle therethrough and therefrom as and to the extent required for its application, enabling thereby the quick achievement of a mop assembly which is easier to manipulate for any given individual and most secure, effective and efficient in use.

14. Apparatus as in claim 12 wherein that surface portion of said saddle portion of said mop support remote from said one surface portion thereof includes relatively projected rib means facilitating the removal during a mopping procedure of such dirt and debris as may be adhered to a surface to be mopped.

* * * * *

UNITED STATES PATENT AND TRADEMARK OFFICE

CERTIFICATE OF CORRECTION

PATENT NO. : 4,995,134

DATED : February 26, 1991

INVENTOR(S) : Patrick H. Monahan

It is certified that error appears in the above-identified patent and that said Letters Patent is hereby corrected as shown below:

Col. 1, line 49, "4,144,224" is corrected to read -- 4,114,224 --.

Col. 8, line 10, "the" (first occurrence) is corrected to read -- The --.

Signed and Sealed this

Twenty-third Day of June, 1992

*Attest:*

*Attesting Officer*

DOUGLAS B. COMER

*Acting Commissioner of Patents and Trademarks*